US007583199B2

(12) United States Patent
Graebe, Jr.

(10) Patent No.: US 7,583,199 B2
(45) Date of Patent: Sep. 1, 2009

(54) AIR CUSHION CONTROL SYSTEM

(76) Inventor: William F. Graebe, Jr., 208 Yorktown Dr., Collinsville, IL (US) 62234

( * ) Notice: Subject to any disclaimer, the term of this patent is extended or adjusted under 35 U.S.C. 154(b) by 22 days.

(21) Appl. No.: 12/069,444

(22) Filed: Feb. 8, 2008

(65) Prior Publication Data

US 2009/0000037 A1 Jan. 1, 2009

Related U.S. Application Data

(63) Continuation of application No. 10/691,821, filed on Oct. 23, 2003, now abandoned.

(60) Provisional application No. 60/421,036, filed on Oct. 23, 2002.

(51) Int. Cl.
*A47C 27/10* (2006.01)
*G08B 21/00* (2006.01)

(52) U.S. Cl. ..... 340/667; 5/713; 5/654; 340/636.1; 340/626

(58) Field of Classification Search ..... 5/654, 5/713, 710, 655.3, 706; 340/626, 573.1, 340/636.1, 635, 540, 667
See application file for complete search history.

(56) References Cited

U.S. PATENT DOCUMENTS 3,463,547 A 8/1969 Brennan et al.
3,503,649 A 3/1970 Johnson
3,533,095 A 10/1970 Collins
3,631,438 A 12/1971 Lewin
3,860,773 A 1/1975 Fontaine
RE28,754 E 3/1976 Cook et al.
4,020,482 A 4/1977 Feldl
4,068,334 A 1/1978 Randall
4,086,458 A 4/1978 Dickey
4,172,216 A 10/1979 O'Shea
4,638,307 A 1/1987 Swartout
4,711,275 A 12/1987 Ford et al.
4,726,624 A 2/1988 Jay
4,753,480 A 6/1988 Morell
4,819,286 A 4/1989 Beauchamp
4,833,457 A 5/1989 Graebe
4,953,913 A 9/1990 Graebe
5,142,717 A 9/1992 Everard et al.
5,144,705 A 9/1992 Rogers
5,450,638 A 9/1995 Johnson
5,473,313 A 12/1995 Graebe
5,487,197 A 1/1996 Iskra, Jr. et al.
5,657,499 A 8/1997 Vaughn et al.
5,797,153 A 8/1998 Amioka
5,797,155 A 8/1998 Maier et al.
6,036,271 A 3/2000 Wilkinson et al.
6,047,423 A 4/2000 Larson
6,092,249 A 7/2000 Kamen et al.

(Continued)

*Primary Examiner*—Alexander Grosz
(74) *Attorney, Agent, or Firm*—Gallop, Johnson & Neuman, L.C.

(57) ABSTRACT

An air cushion control system having an air chamber sensor including an air chamber, a bottom out sensor and an overinflation sensor, an air pump to inflate the air chamber, an air valve to release air from the air chamber, connections for the air cushion control system to an air cushion, and a microprocessor to control the inflation and the release of air from the air chamber. The air cushion control system reduces decubitus ulcers by incorporating both an automatic adjustment system to prevent the seated individual from bottoming-out in the air cushion and measure immersion depth to maximize pressure reduction.

34 Claims, 14 Drawing Sheets

U.S. PATENT DOCUMENTS 6,216,299 B1 4/2001 Kohlman
6,385,804 B1 5/2002 Barber et al.
6,598,250 B1 7/2003 Pekar
6,598,804 B2 7/2003 Ruehle et al.
6,772,639 B2 8/2004 Seals

AIR CUSHION CONTROL SYSTEM

This application claims the benefit of U.S. Provisional Patent Application No. 60/421,036, filed Oct. 23, 2002, and is a continuation of U.S. patent application Ser. No. 10/691,821, filed Oct. 23, 2003, which became abandoned in favor of and subsequent to the filing of the present application.

FIELD OF THE INVENTION

The present invention relates to an air cushion control system. The system automatically adjusts inflation and immersion levels for a person using an air cushion to reduce the occurrence of decubitus ulcers.

BACKGROUND OF THE INVENTION

Individuals who are wheelchair dependent generally need special cushioning to help prevent the formation of decubitus ulcers, which are often commonly referred to as pressure sores or bedsores. These individuals are often paralyzed and have lost sensation or have impaired sensation in their lower extremities. This loss or impairment of sensation presents problems associated with both bottoming-out in and the adjustment level of the cushion that the individual is sitting on. Bottoming-out raises the peak pressures on the skin in the bottomed-out areas of the individual to levels such that the blood flow in the capillary bed in the bottomed-out areas will be stopped (occluded) or reduced, which prevents vital nutrition from reaching the cells. This may cause necrosis or cell death and result in the onset of a decubitus ulcer. Improper adjustment or immersion can also result in decubitus formation.

Many variations of cushioning exist, including foam, gel, water-filled, air, foam and gel combinations, and air and foam combinations, etc. Cushioning to aid with pressure reduction must generally be adjusted to provide the proper fit for the shape of the user to distribute weight load on the skin to reduce pressures. These adjustments may involve sculpturing the foam to fit the contours of the person's body or adding special gel bags to a gel filled cushion. Air cushions generally require the checking of immersion depth by inserting one's hand under the buttocks. These adjustments may also include the checking of pressures with expensive computerized equipment. These adjustments are often specific and customized to the individual resulting in increased costs. Moreover, in nearly every instance where an individual shifts or adjust their seating posture, a new adjustment to the cushion may be required.

Conventional cushions have many disadvantages. Cushions may ultimately go out of adjustment or may deteriorate. Repeated use of a foam cushion may break down the cell structure of a foam cushion. Cushions may leak air or gel. Gel may become dry or become firm with the passage of time. Cushions may further change adjustment due to temperature or altitude changes.

If an individual lacks or has impaired sensation, they generally cannot detect that their cushion has failed to support their body properly. The individual may not be aware that a problem exists, until such time that a decubitus ulcer may have already formed. Even if aware of the fact that their cushion is bottomed out, misadjusted or has failed, many individuals cannot adjust their cushion by themselves due to their physical handicaps.

SUMMARY OF THE INVENTION

The ultimate goal of a seating system for reducing decubitus ulcers is to contact as much skin surface area of the seated individual as possible to provide weight distribution to lower pressures on the skin. This may be accomplished by immersing the individual in a cushion by releasing air from the cushion without bottoming out. The present invention accomplishes this goal.

The air cushion control system of the present invention generally: a housing that contains the electrical controls and an air chamber sensor surrounded by bottom out sensors and overinflation sensors. The air cushion control system is connected to the air cushion to be controlled. The present invention provides an air cushion control system for reducing decubitus ulcers by incorporating means for both an automatic adjustment system to prevent the seated individual from bottoming-out in the air cushion control system and a means to measure immersion depth to maximize pressure reduction. The air cushion control system incorporates alarms that alert the seated individual or caregivers to seat cushion problems, which could cause serious skin problems.

It is an aspect of the present invention to provide an air cushion control system that automatically adjusts immersion depth of the individual into the air cushion based upon the specific weights, sizes and shapes of any individual.

It is an aspect of the present invention to provide an air cushion control system that automatically adjusts to the different seating positions and movements of the seated individual and keep them properly immersed without bottoming out.

It is another aspect of the present invention to provide an air cushion control system that reduces the bleed-out of air from the air chamber sensor into the air cushion to enhance battery life.

It is another aspect of the present invention to provide an air cushion control system that may be used with wheelchairs, beds, and the seating of cars, trucks, and airplanes.

BRIEF DESCRIPTION OF THE DRAWINGS

The present invention is illustrated by the embodiments shown in the drawings in which.

DETAILED DESCRIPTION OF PREFERRED EMBODIMENTS

Figure 1:
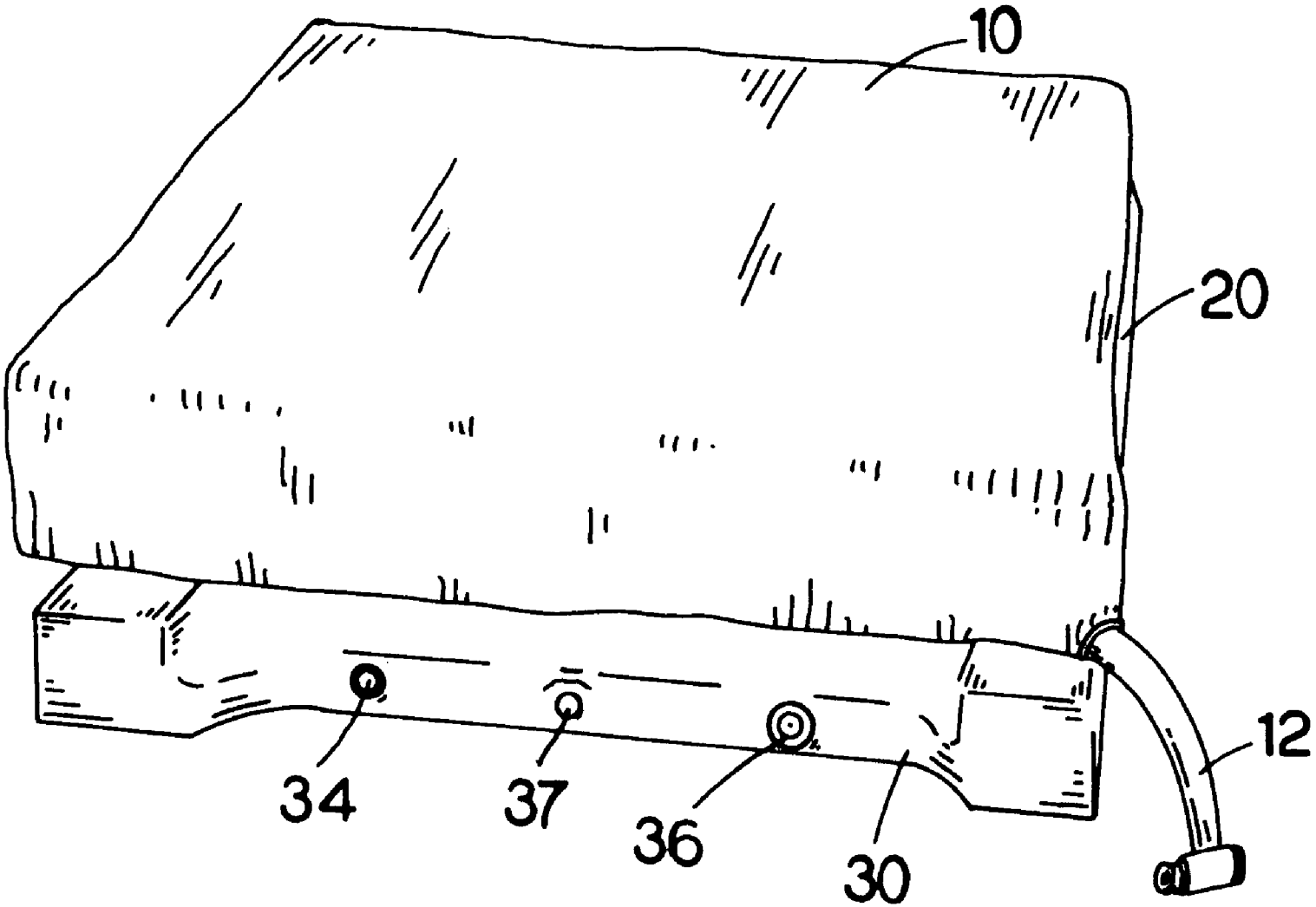
FIG. 1 is a perspective view of an air cushion control system and illustrates an air cushion and a housing.
Figure 2:
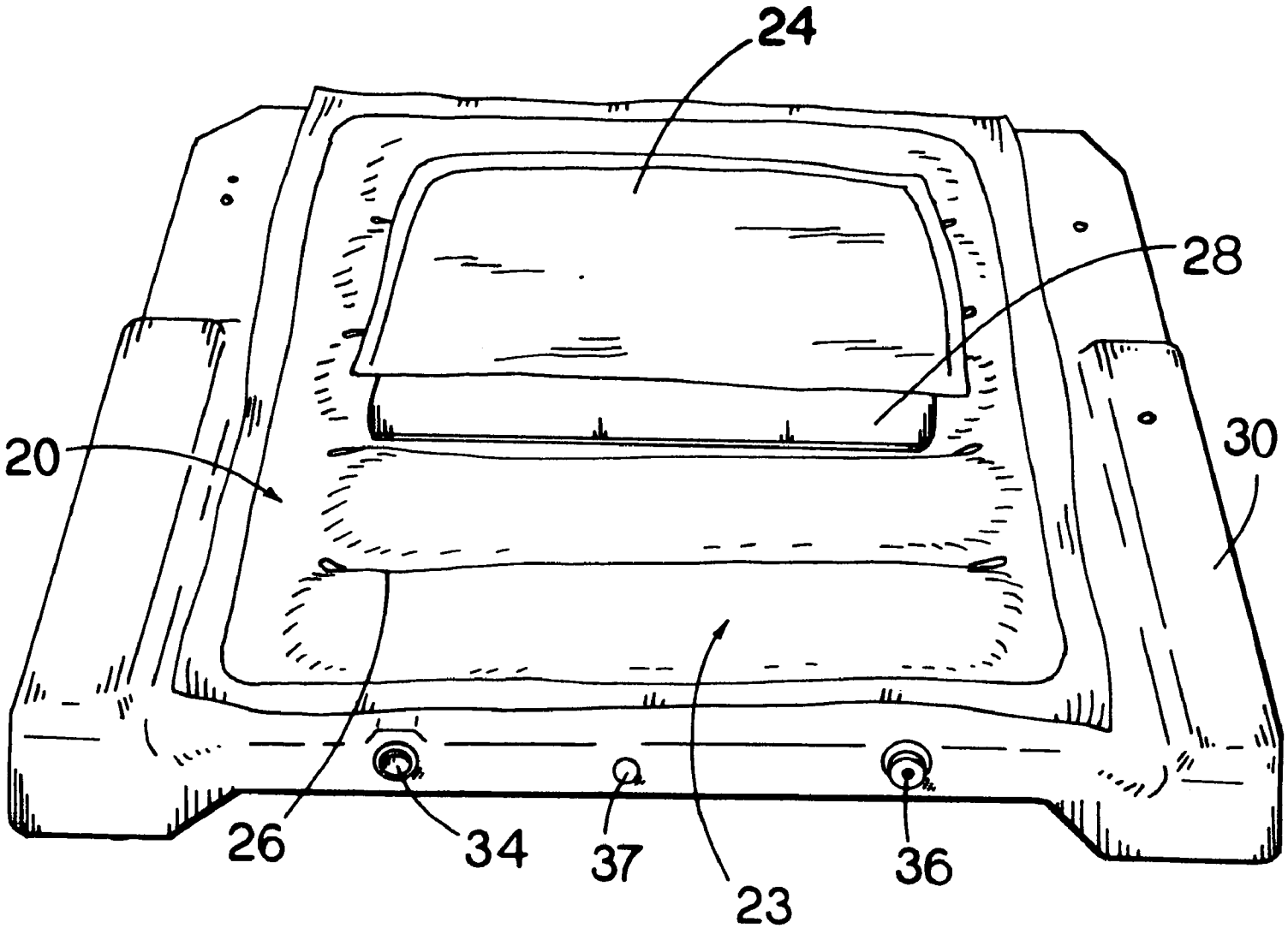
FIG. 2 is a perspective view of the housing and an air chamber sensor thereon.

The air cushion control system of the present invention generally comprises: a housing and an air chamber sensor, a bottom out sensor, an overinflation sensor and an electronic control system. The housing is generally a firm structure that contains an air pump, an air valve, batteries, a microprocessor and other components. The air chamber sensor generally rests on top of the housing and is connected to the housing by air tubes and air connects. Under the air sensor, are both bottom out sensors and a reed switch that controls overinflation. The air cushion control system is connected to the air cushion to be controlled. The air cushion generally rests on top of the air chamber sensor and is connected to the housing by air tubes and air connects. Thus, the air chamber sensor is generally between the housing and the air cushion.

The air cushion control system of the present invention provides the user a seating cushion surface that automatically adjusts to the user's individual weight and specific contours. The system may also be used serially by different individuals with different shapes and of different sizes and still provide an automatically adjusted seating surface.

The air cushion control system of the present invention may be used with many commercially available air cushions. Air cushions come in many different sizes but are typically about sixteen inches by eighteen inches in size and contain many individual air cells.

The system also re-adjusts the seating surface when the user bottoms-out from a shift in seating position by the user. For example, the user may cross their legs changing the support resulting in a bottom-out. The system will recognize these shifts in seating position if they result in a bottom-out of the user and will subsequently readjust the seating surface to reduce or stop the bottom-out. If overinflation results from various position changes, the system will remove air to maintain the user deeply immersed in the air cushion.

The adjustment is controlled by a microprocessor that may be activated by pressing an adjustment button or by simply sitting on the air cushion attached to the air cushion control system of the present invention. When an individual sits on the air cushion and bottoms-out, bottom-out sensors are activated and initiate the air pump. The bottom-out sensors and the air pump are operationally connected to the microprocessor. The air pump provides air to the air chamber sensor, which is in communication with the air cushion via air tubes and air connects. Thus, as the air enters the air chamber sensor, it also enters the air cushion and raises the individual off the bottom-out sensors. As the air sensor chamber expands in height, the user seated in the cushion is raised an equal amount.

To assure the lowest immersion depth in the air cushion, the sitting individual may press the adjustment button. Upon pressing the adjustment button, an audible alarm will sound momentarily to assure the user that they have properly activated the adjustment system. This then initiates a series of events. First, an electrically activated air valve is opened. The air valve is operationally connected to the microprocessor. Secondly, three timing sequences may be initiated. The first timing sequence in the microprocessor measures how long the user can be bottomed-out before an alarm will sound. The first timing sequence may be user adjustable by means of a dip-switch located on a circuit board of the microprocessor. The second timing sequence is part of a battery saver system that automatically measures how much time will be allowed before the adjustment sequence is completed. The third timing sequence allows the air pump to continue to operate for a defined period of time after the individual is raised off the bottom-out sensors.

Upon opening of the air valve, air is released from both the air cushion and the air chamber sensor, allowing the individual to be immersed into the air cushion. However, if the individual is immersed too deeply in the air cushion, they will bottom out. To reduce and control the bottoming-out, a sensor board may be contained in a pocket of the air chamber sensor that has strips that will push through the air chamber sensor to contact the bottom-out sensors located on top of the housing, i.e., under the air chamber sensor. The strips of the sensor board may be made to different thicknesses to control the immersion depth of the individual seated on the cushion. In other embodiments, the air chamber sensor may have strips incorporated internally into it or onto it to activate the bottom-out sensors and achieve the proper cushion adjustment.

In a preferred embodiment, the bottom-out sensors comprise pressure strip sensors attached on or integral to the top of the housing. When the pressure strip sensors are contacted, the air valve is closed and the air pump is now activated. The air pump will continue to operate until the sensor board is no longer in contact with the pressure strip sensors. When the pump discontinues operation, an immersion depth for the individual is determined.

The air cushion control system also utilizes an overinflation system that recognizes when an occupant is adjusted to a point that they are sitting too high (i.e., not immersed properly into the air cushion). Sitting on an over-inflated seat cushion is similar to bottoming-out since it prevents immersion and raises peak pressures and may cause a decubitus ulcer. Sitting on an over-inflated seat cushion also reduces the stability of the individual and should be avoided. The overinflation system is controlled via a magnetically activated reed switch and a magnet. The reed switch may be contained in the housing and positioned under the air sensor chamber and is operationally connected to the microprocessor. The magnet is preferably attached to the sensor board, which may be located in a pocket on the top surface of the air chamber sensor. In other embodiments, the magnet is attached or integral to the top surface of the air chamber sensor.

The magnet should have sufficient strength to hold the reed switch open while the magnet is within a certain proximity of the reed switch. When the air chamber sensor has risen to a distance that is outside of the range of the magnet's strength, the reed switch will close and complete the circuit and open the air valve. The air is then released from the air cushion and the air chamber sensor until the sensor board and magnet contacts the bottom-out sensors, opening the reed switch, closing the air valve and activating the air pump. Once the reed switch is opened, it is temporarily removed from the system by the microprocessor until the bottom-out sensors are activated, which re-engages the reed switch and its magnetic control.

The first timing sequence described above measures out how long the strips of the sensor board remain in contact with the bottom-out sensors without an audible or visible alarm being activated. The time may range from about zero seconds, which is mainly used for a testing mode or the LED mode, up to about 30 seconds in ten second increments. These time sequences can be changed by dip switch or reprogramming the microprocessor. If the strips of the sensor board have not been raised sufficiently to not be in contact with the pressure sensor strips in the measured period of time, an alarm will sound. This alarm would normally indicate that the adjustment is either not finished or that an air leak has occurred in the system and that the user of the device or a caregiver should respond by checking the system for air leaks or other problems. Small air leaks may set up a cycling that will set off the alarm. As the air leaks may grow in size, the pump cannot override the leaks causing the alarm to begin to activate on a cyclical basis or provide a steady alarm sound.

The second timing sequence described above is a battery saver system designed to monitor the air valve. If during handling, transferring from the chair, or storage, the adjustment button is activated without an occupant on the seat cushion, the timing system will close the air valve and deactivate the system. Otherwise, the air valve would remain open and would drain the batteries. However, if the unit is stored in an automobile trunk or other area that would prevent the alarm from being heard, the user upon retrieving it from the storage area, would possibly find that the system is totally inoperative due to battery drain.

The battery saver system may also assist in preventing battery drain caused by environmental conditions. If the system is not occupied, the air chamber sensor may increase in the volume of air raising the internal air pressure due to heat or altitude. These fluctuations may activate the air valve and drain air out of the system. However, without an occupant, the bottom-out sensors will not activate. It is necessary to activate the bottom-out sensors to close the air valve. Thus, it is preferred that after a measured period of time, the system will automatically close the air valve to preserve battery life.

A third timing sequence may also be initiated to allow the pump to continue to run for a short period of time after the bottom-out sensors are no longer tripped by the strips of the sensor board. This allows the air pump time to add a short amount of extra inflation to help assure that the strips of the sensor board are no longer touching the bottom-out sensors. This minimizes the contact between the strips and bottom-out sensors and reduces the use of the air pump thereby conserving battery power.

The bottom-out sensors may be activated by changes in the sitting position of the individual. The bottom-out sensors will automatically activate the air pump and make an adjustment to accommodate different sitting positions. All of the timing sequences mentioned above are also activated. The timing sequences keep the audible alarm system quiet unless a problem should occur.

Turning now to some of the other features that may be incorporated into the air cushion control system of the present invention:

In some embodiments of the present invention, an alarm is used to indicate that an overinflation condition has occurred and has not been corrected. The microprocessor may be programmed to sound an alarm if the bottom-out sensors are not contacted after 10, 20, or 30 seconds or other user programmed time period from the closing of the reed switch. The alarm will provide a signal by a pulsating audible or visual signal different from the bottom out alarm that an overinflation condition is persisting.

The air cushion control system of the present invention may also be activated by an air pressure activated switch connected to the air chamber sensor and/or the air cushion. The air pressure activated switch provides for automatic recognition of an individual on the seating surface and automatically initiates the adjustment. While the air cushion control system is vacant (no occupant) the air pressure within the air chamber sensor and attached cushion is very low. When an individual sits upon the system, the air pressure is increased due to the occupant's weight. This increase in air pressure will be recognized by the air pressure activated switch operationally connected to the microprocessor, which will then activate the adjustment procedure described above, which may be activated manually by the adjustment button in other embodiments. Thus, the air cushion control system recognizes and automatically accommodates a sitting individual. The air pressure activated switch is deactivated after the initial weight or occupant is registered and is only reactivated when weight is released, when the individual is no longer sitting on the air cushion control system. This allows for recognition that an adjustment is no longer needed as the occupant has left.

The air cushion control system of the present invention may also be activated by a pressure strip sensor or other switching means mounted on the bottom of the housing, or other suitable location. Upon sitting on the system, the pressure strip sensor is activated by the weight of the sitting individual. This activation then starts the same adjustment procedure as described above. However, the strip sensor is deactivated after the initial weight is registered and is only reactivated when weight is released, e.g., when the individual is no longer sitting on the air cushion control system. This allows for recognition that an adjustment is no longer needed as the occupant has left.

An optional LED light system or a visual read out display indicating the adjustment process or condition may be incorporated into the system. The LED will provide silent operation and will operate in place of the audible alarm. The LED light visual read out system will provide a steady light/read out or an alternating light/read out to alert the user or caregiver of problems. When the LED/read out system is plugged into the circuit board, it automatically disconnects the audible alarm. When LED/read out system is unplugged, it automatically reactivates the audible alarm. The LED system can be operationally connected to a lighted push-button on the front of the housing. Pushing the lighted push-button will activate the system. The lighted push-button would flash the same codes as the audible alarm system. The LED/read out light could also be plugged into a socket mounted on the side of the housing. Optionally, the LED/read out light could be mounted on the arm of the wheelchair. If the LED/read out light is accidentally disconnected, the audible alarm would be immediately reactivated. The visual readout display would also flash and display a written message indicating the condition, i.e., bottom out.

An audible alarm (short beep) may be incorporated that will sound when the batteries have been installed properly. If the batteries are installed incorrectly, the alarm will not sound and the system will not operate. This is provided as a protection system so the user will install the batteries in the proper polarity. However, if the batteries are installed in a reverse polarity, a protection system is built into the circuit board that will prevent damage to the circuit board and system.

Individuals using this system often have no sensation in the lower extremities and do not sense that their cushion is not operating properly. Also with the time delays involved they would not normally hear or see any type of alarm. Therefore, a low voltage monitoring system may be incorporated as part of the electronics of the system. The monitoring system is designed to detect low voltage when the batteries have dropped to a low voltage level. At this point, the system is still operative and will remain so for some time. However, an audible alarm will activate and will continue to operate every 8 to 10 seconds providing a pulsating sound until the batteries have been replaced. It is important that only new batteries should be used to replace the batteries in the system. To prevent the use of incorrect batteries, batteries that are not of sufficient voltage to arrive at the required voltage level, the alarm will be activated and cannot be turned off until the batteries have been replaced with those of sufficient voltage. The alarm sequence will be either audible or an LED/read out light depending on the selection of the occupant.

The air cushion control system of the present invention and embodiments thereof will now be described with reference to the drawings:

With particular reference to FIGS. 1-4, the air cushion control system of the present invention generally comprises: a housing 30 and an air chamber sensor 20, a bottom out sensor 33, an overinflation sensor, and a microprocessor control system 50. The air cushion control system is connected to an air cushion 10 to be controlled. The air chamber sensor 20 generally rests on top of the housing 30 and is connected to the housing 30 by air tubes 12 and air connects 36.

The bottom out sensors 33 and the over inflation sensor are located below the air sensor chamber. In this embodiment, the over inflation sensor comprises a magnet 25 and a reed switch 64. The air cushion 10 generally rests on top of the air chamber sensor 20 and is connected to the housing 30 by air tubes 12 and air connects 36. Thus, the air chamber sensor 20 is generally between the housing 30 and the air cushion 10. The housing 30 may have hatches or doors providing access to the internal features of the housing 30 for changing the batteries or performance or other adjustments. These hatches or doors may be on the bottom side of the housing.

Figure 8:
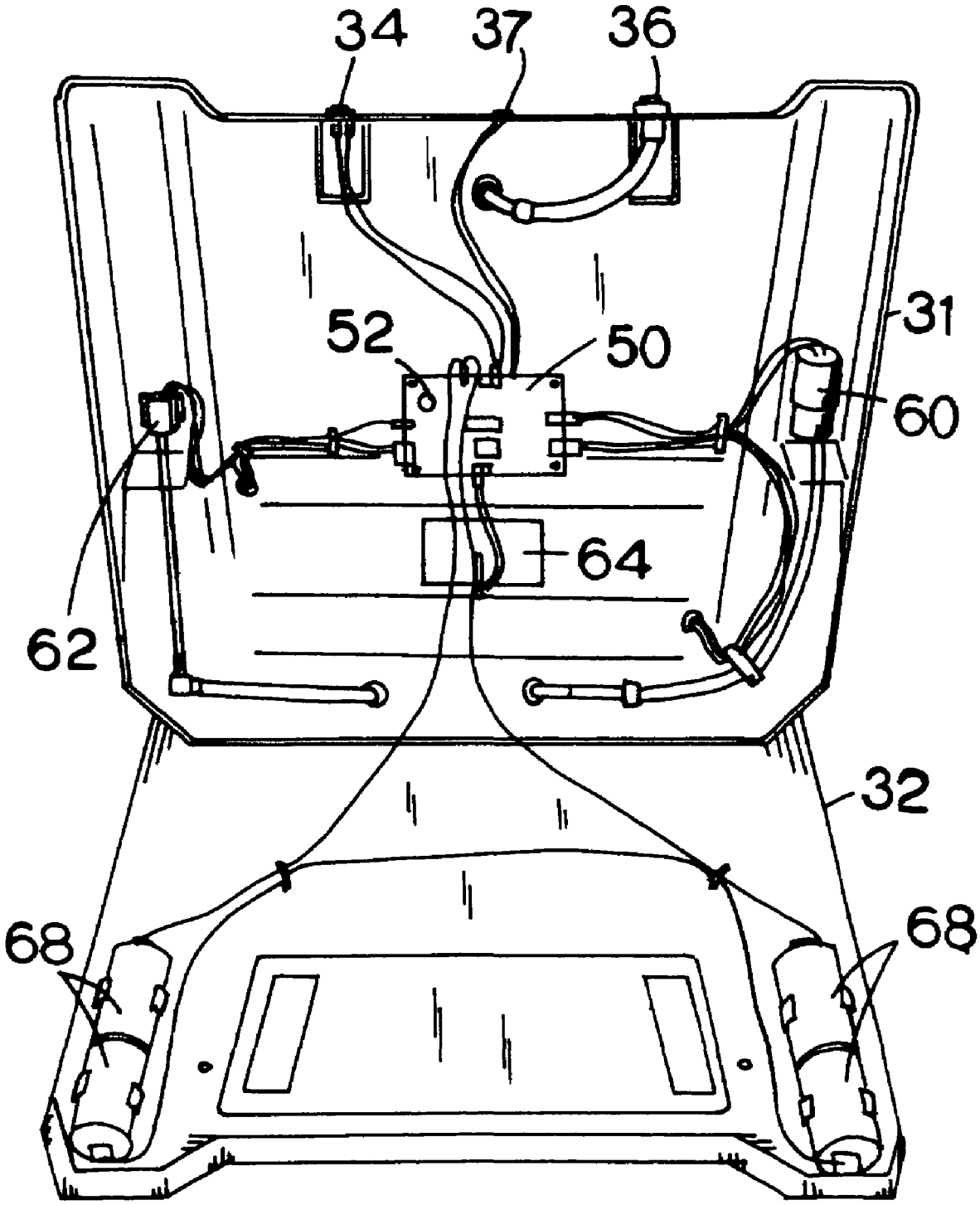
FIG. 8 is a perspective view of the inside of the housing.

Turning now to FIG. 8, the housing 30 is generally a solid supportive structure that contains an air pump 60, a solenoid air valve 62, batteries 68, a microprocessor 50, an alarm 52, a reed switch 64, strip sensors, and other components. The housing 30 is comprised of a lower housing 32 and an upper housing 31. The microprocessor 50 may comprise any of a variety of microchips and/or circuits and/or other components well known to one of ordinary skill in the art and needed to perform the sequences and control the events herein described.

Figure 5:
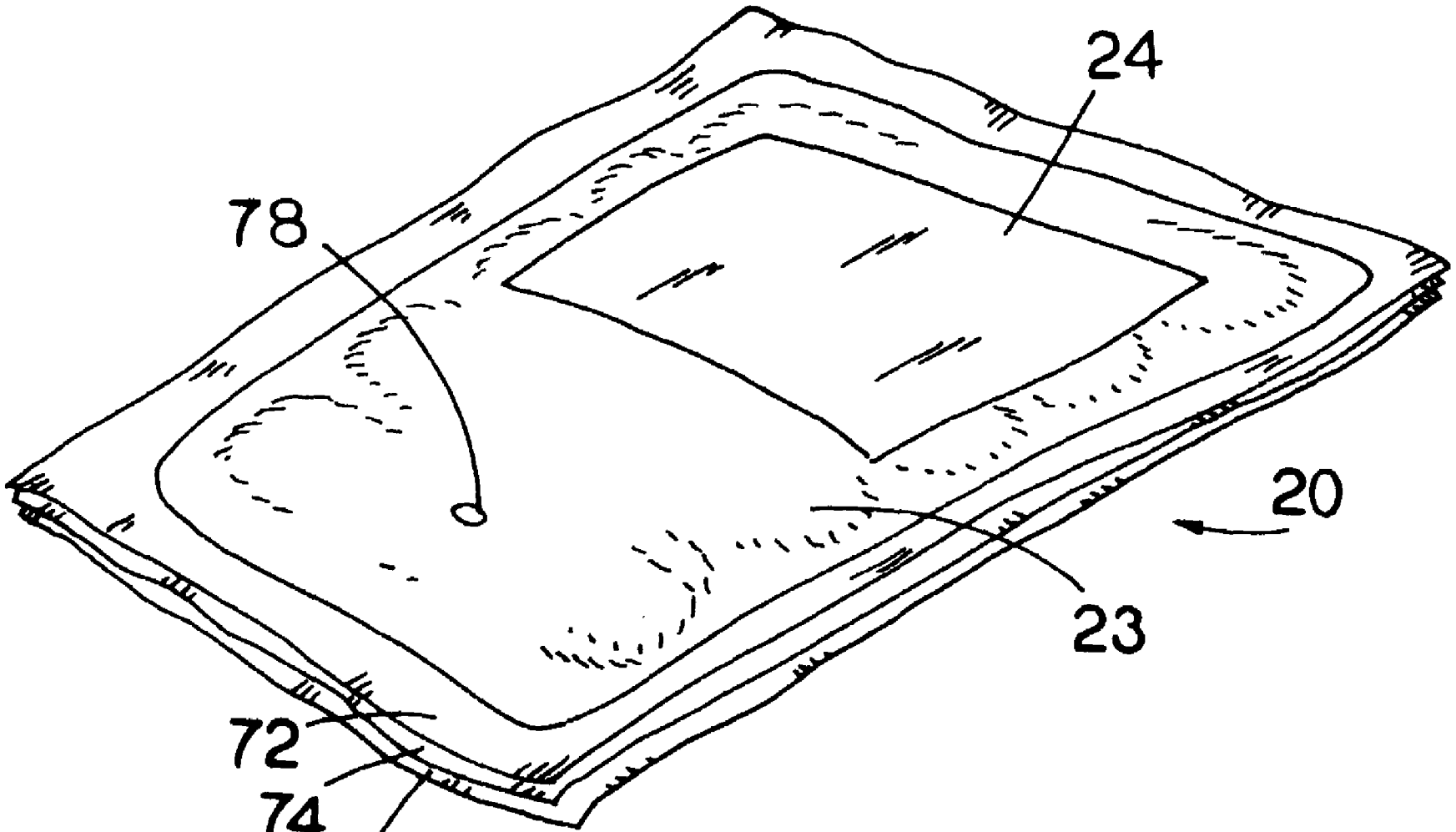
FIG. 5 is a perspective view of the air cushion.
Figure 6:
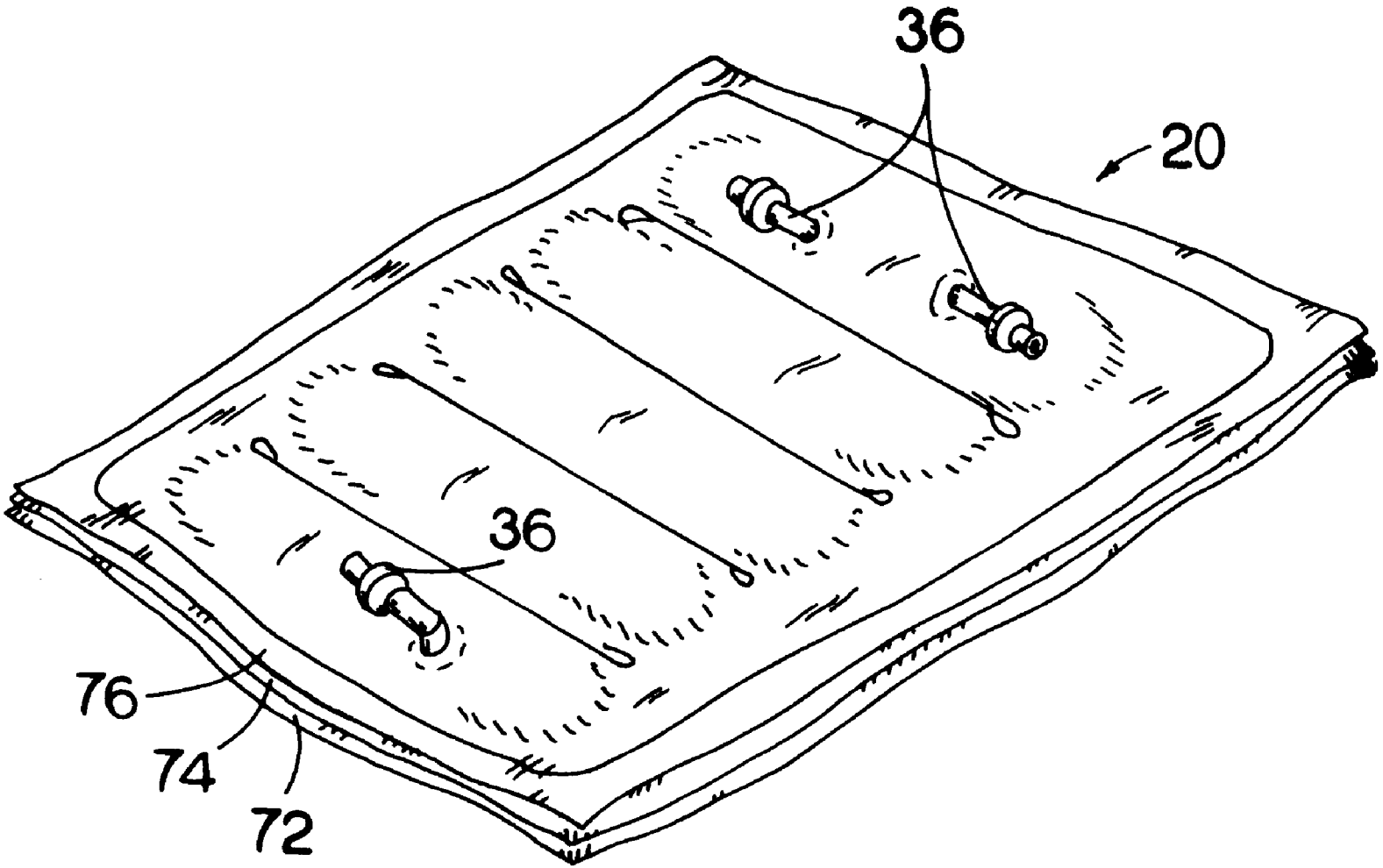
FIG. 6 is a perspective view of the bottom of the air cushion.
Figure 7:
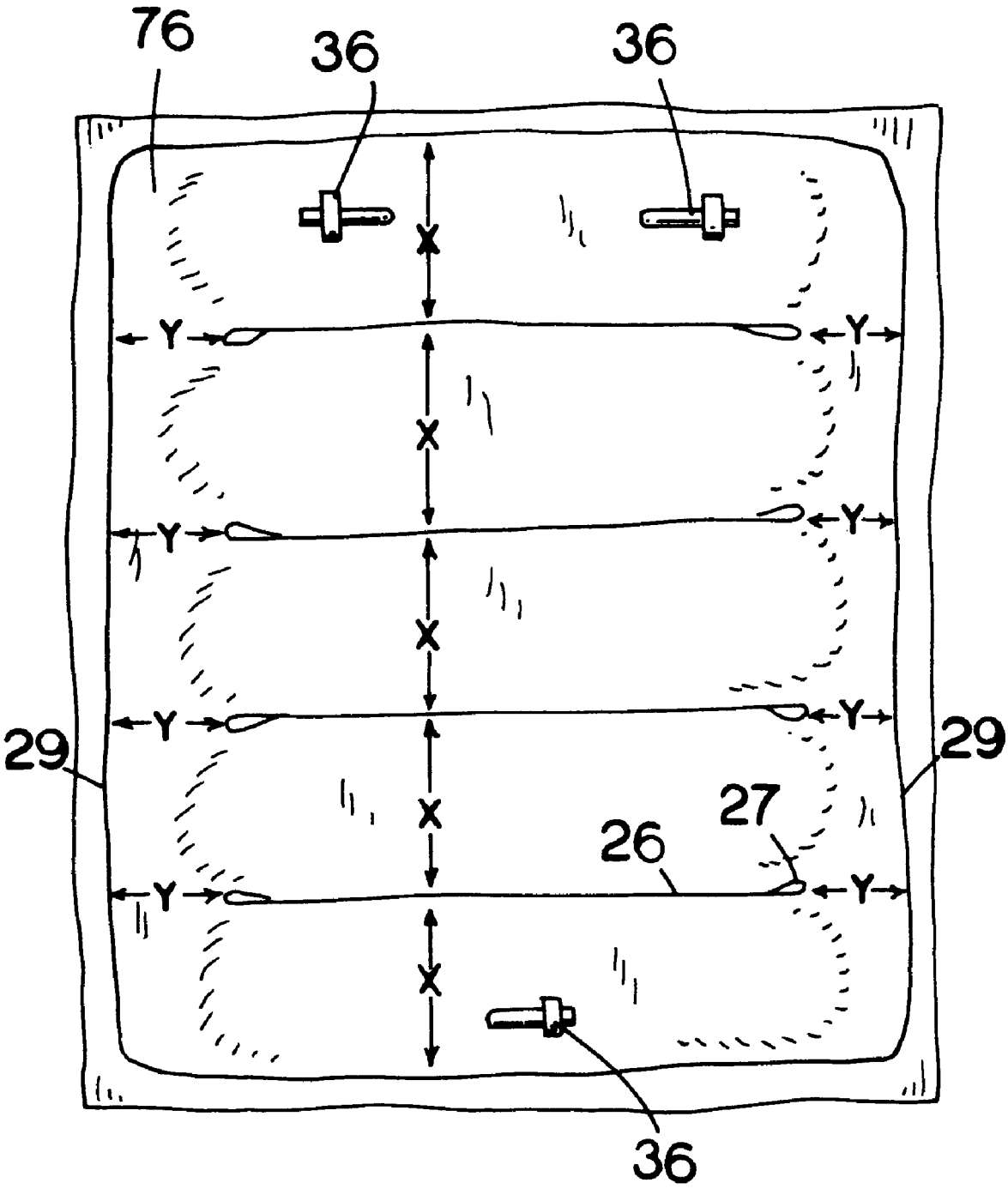
FIG. 7 is a view of the bottom of the air cushion.

Turning now to FIGS. 5-7, the air chamber sensor 20 may comprise four layers. As shown in FIG. 5, a bottom layer 76 and a middle layer 74 are sealed together at points to form internal seals of ribs or spacers shown as channel walls 26 that control the inflation level of the air chamber sensor 20 and its stability. The channel walls 26 define air channels 23. The channel walls 26 extend a substantial portion of the distance between the edges of the air chamber sensor 20. The spacing of these channel walls 26 limit the height level of inflation within the air chamber sensor 20 and provide stability and help to govern air flow and regulate air flow to the air cushion 10 and reactive timing for adjustment. With particular reference to FIG. 7, the distance or spacing at the ends of the channel walls 27 to the edge of the air chamber sensor 29 (shown as "y") must be no more than about one half the distance between the ends of the channel walls 27 (shown as "x"). Explained another way, the combined distance between the edge of the air chamber sensor 29 and end of channels walls 27 for each side of the channel walls 27 will be about equal to the distance that the channel walls are apart from each other (2y=x). The excess material from the sealing of the layers at the edge of the air chamber sensor 29 as shown in the figures is preferably trimmed.

A top layer 72, i.e., a third layer of material, may be sealed to the bottom layer 76 and the middle layer 74. The top layer 72 may be provided with a hole 78 to prevent any leakage from being contained by the top layer causing excessive expansion.

Figure 3:
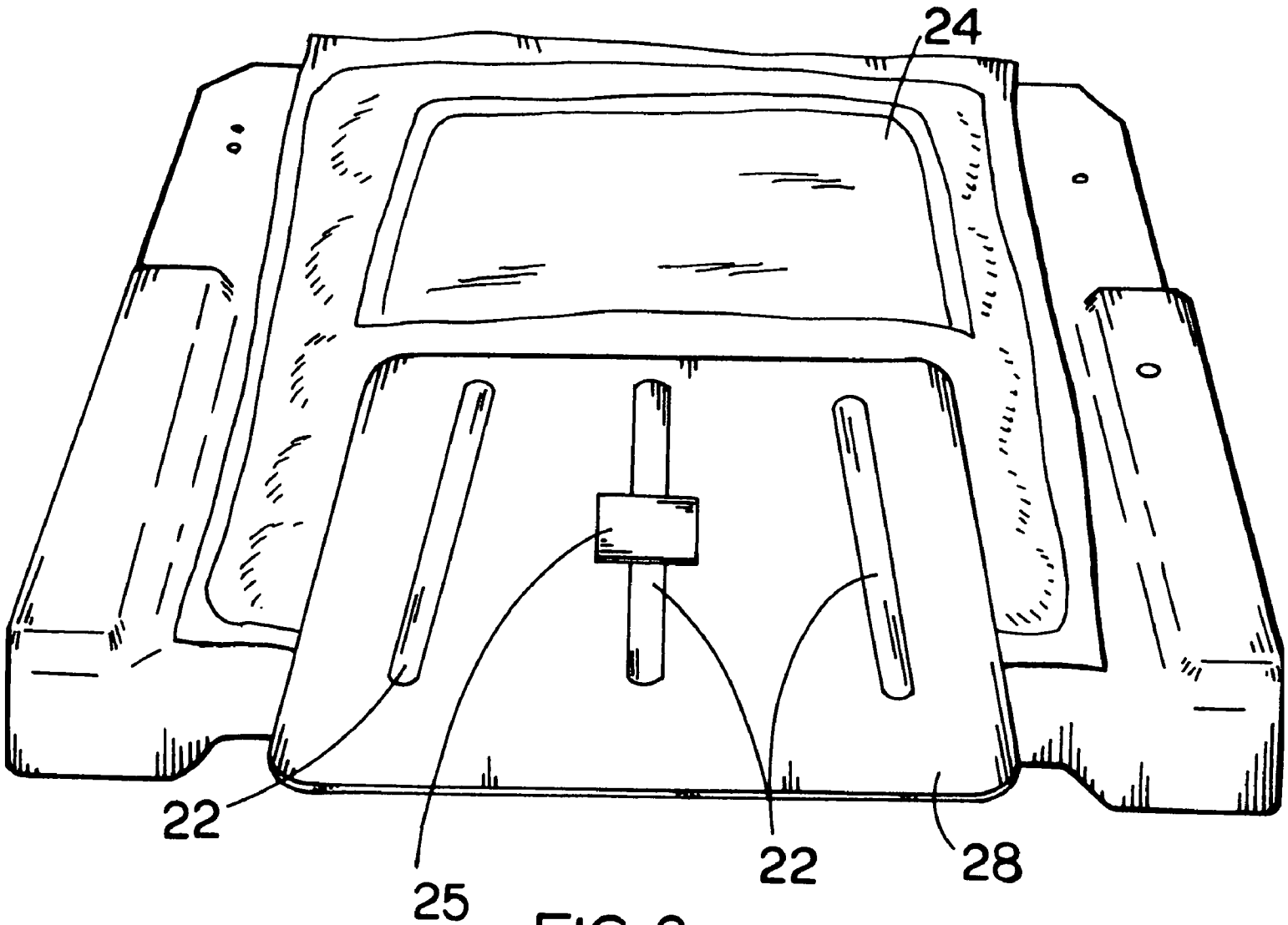
FIG. 3 is a view of the bottom of a sensor board after being removed from a pocket of the air chamber sensor.

In order to accommodate the sensor board, a fourth layer of material may be sealed to the top layer 72 to form a pocket 24 to hold and position a sensor board 28. As shown in FIG. 3, the bottom of the sensor board 28 has strips 22 and a magnet 25 affixed or attached thereto. The strips 22 contact pressure strip sensors 33 on top of the housing 30. The magnet 25 controls the reed switch 64, which controls overinflation. In FIG. 3, the sensor board is shown inverted.

Figure 4:
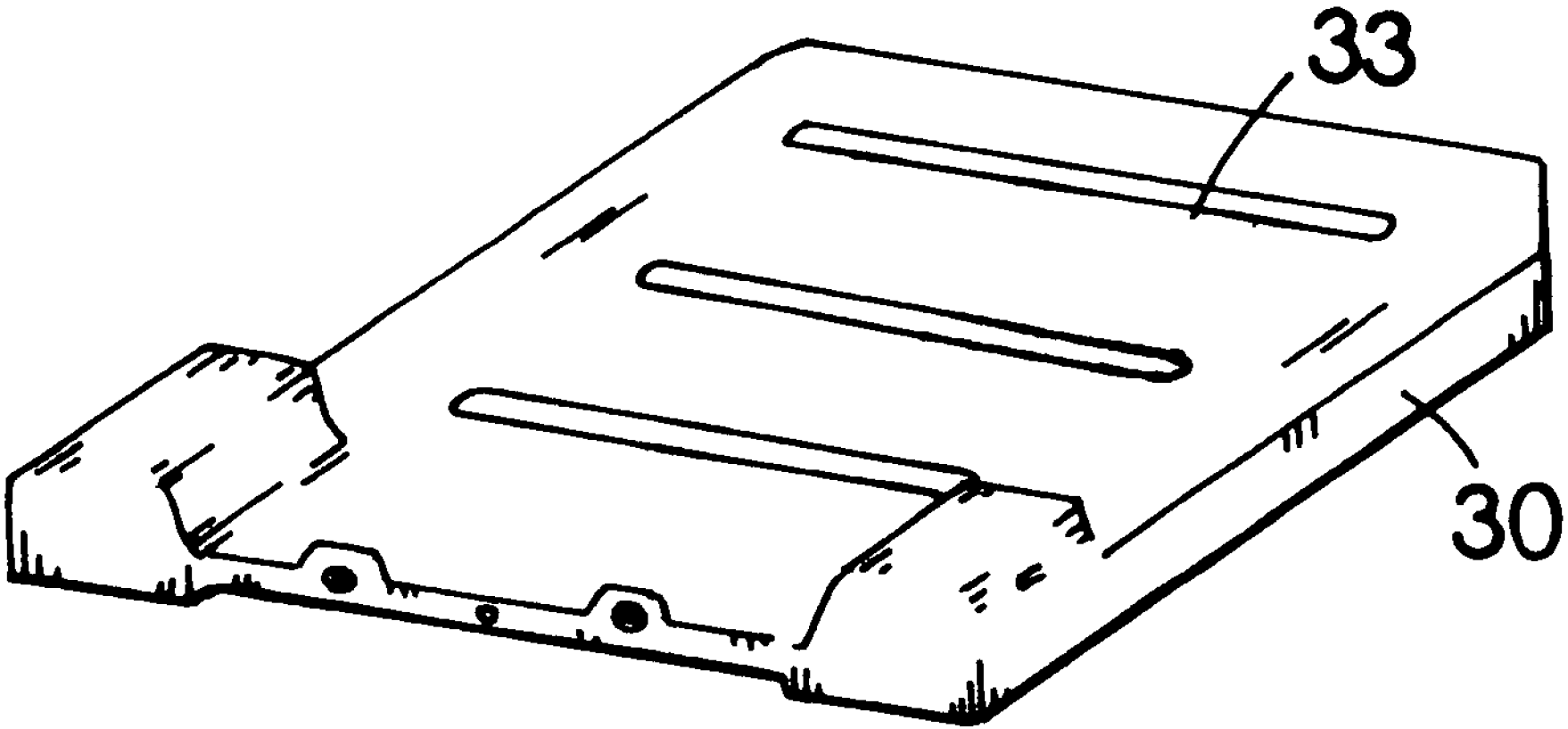
FIG. 4 is a view of a top surface of the housing.

Turning now to FIG. 4, the pressure strip sensors 33 are shown on top of the housing 30. These pressure strip sensors 33 are located either from side to side or front to back of the housing 30 under the air chamber sensor 20. Pushing anywhere along the length of the pressure strip sensors 33 will close a circuit connected to the microprocessor 50. When the pressure strip sensors 33 are contacted, they indicate a low immersion depth of the individual and/or bottoming-out of the air cushion. Although three pressure strip sensors 33 are shown, any number of pressure strip sensors may be used with the present invention.

The air chamber sensor 20 requires air connects 36 for air to enter the air chamber sensor 20 and for air to exit the air chamber sensor 20. The air chamber sensor 20 is preferably constructed with three or more air connects 36. An air connect 36 is provided for each of the air pump 60, the air valve 62, and for the air entering and exiting from the air cushion 10. In some embodiments, the air connects are provided on the sides of the air chamber sensor 20.

The air pressure that is within the air chamber sensor 20 is very low. When an occupant is not sitting on the system, the pressures within the air cushion 10 and within the air chamber sensor 20 are extremely low. Thus, when sitting idle, the weight of the air cushion 10 will override the air pressure in the air chamber sensor 20. The air in the air chamber sensor 20 will bleed back into the air cushion 10. So when an individual sits down on the system, they will bottom out, activate the pressure strip sensors 33, and activate the air pump 60 for a short period of time. As soon as the pressure strip sensors 33 are activated, they override the need to push the adjustment button 34. This can be confusing to a user.

Figure 9:
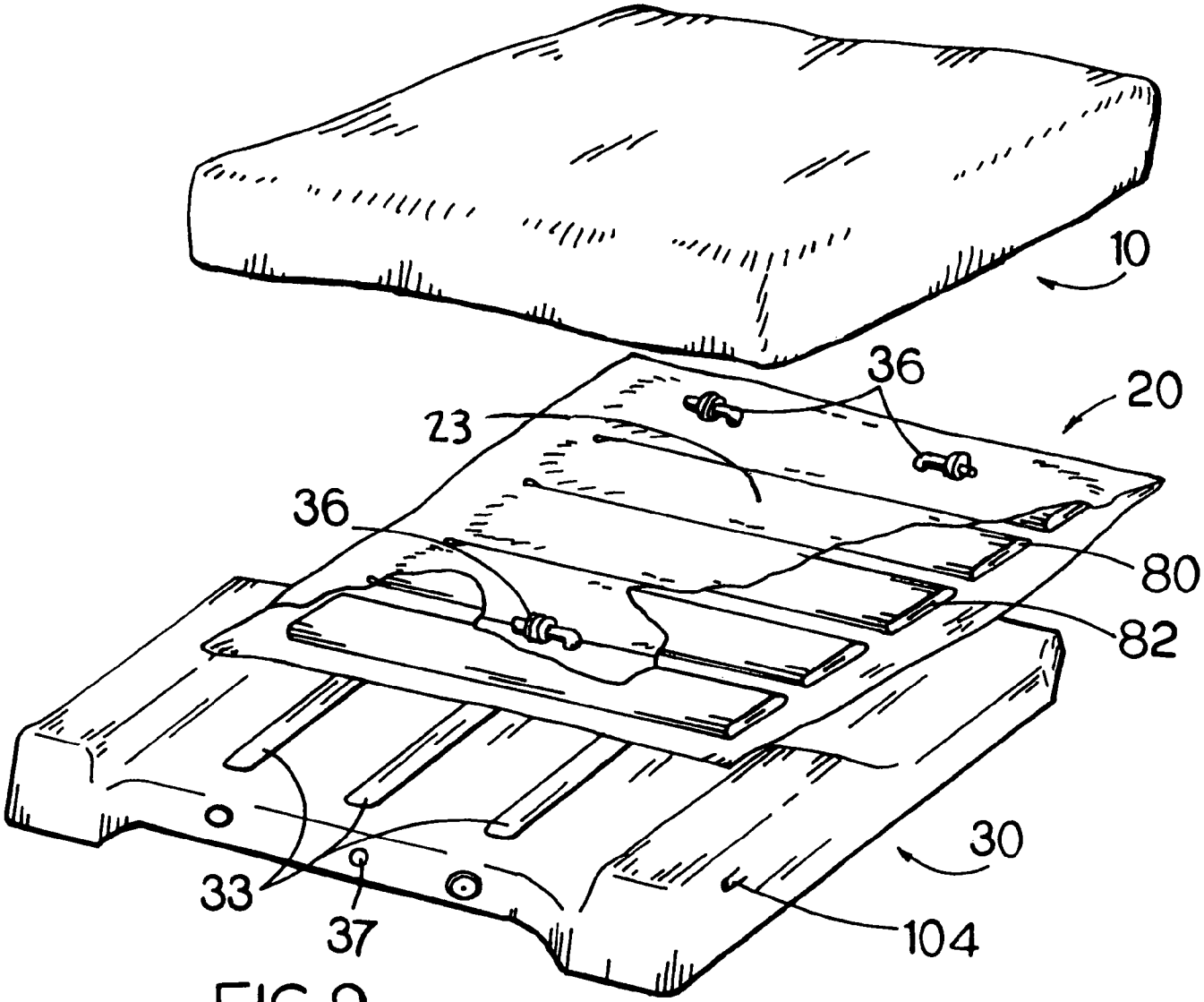
FIG. 9 is a view of the air cushion, the air chamber sensor with inserts, and the housing.
Figure 10:
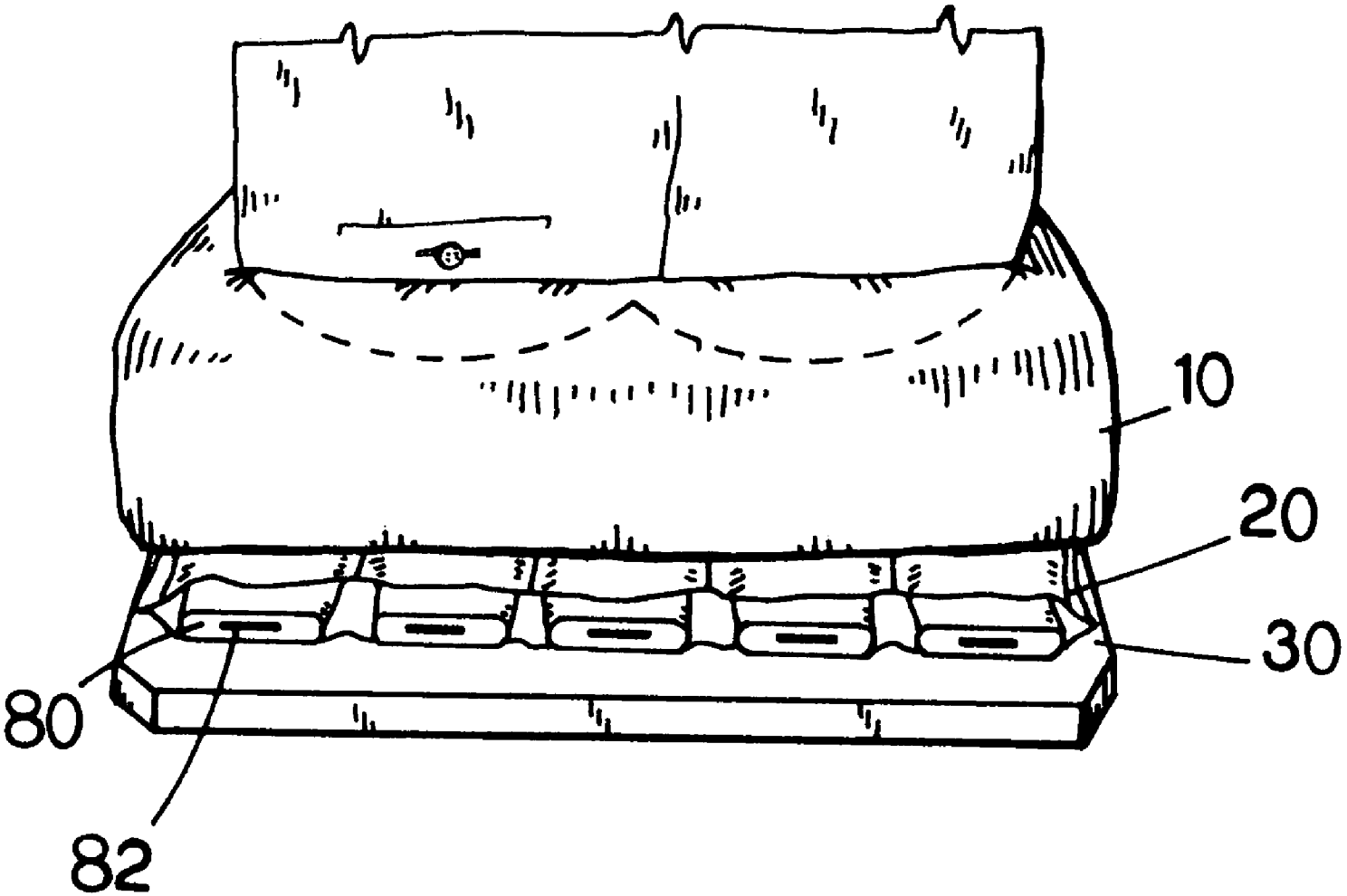
FIG. 10 is a view of the operation of the air cushion control system of the present invention wherein the air chamber sensor has the inserts therein.

However, as shown in FIGS. 9 and 10, by inserting support strips 80 of a foam or plastic cushioning material in the air channels 23 of the air chamber sensor 20, the bleeding of air into the air cushion 10 from the air chamber sensor 20 may be reduced or prevented. The support strips 80 would be of a proper height and a proper width to achieve proper actuation of the bottom out sensors and adjustment in either a compressed or non-compressed state. The density of the material used in support strips 80 should be such that it will just balance out the weight of the air cushion 10 and prevent the bleeding of the air from the air chamber sensor 20 back into the air cushion 10 while unoccupied. The support strips 80 help the air chamber sensor 20 to remain in the previous adjustment for the user and thus reducing the activation of the air pump 60. This will be an advantage to the user and will also help to improve battery life. In FIG. 9, the air chamber sensor 20 is shown inverted. In other embodiments, bleed out may be reduced by the incorporation of strips, such as, for example, foam strips of approximately ½ inch, under the air chamber sensor 20 along the left and right exterior edges. These strips help support the air chamber sensor 20.

In some embodiments of the present invention, the air chamber sensor 20 may also have plastic strips 82 or strips of another hard material inserted into the air channels or attached to the bottom of the air chamber sensor to replace the strips 22 on the sensor board 28. The thickness of the plastic strips 82 and, if combined with foam (when compressed), help determine the depth of immersion. The strips are preferably perpendicular to the pressure strip sensors 33 or other bottom-out sensor.

In some embodiments of the present invention, the air chamber sensor 20 may also have plastic strips 82 matted to the support strips 80 or placed inside of the support strips 80. These plastic strips along with the foam may replace the strips 22 on the sensor board 28, as well as balance out the air in the air chamber sensor 20 versus the weight of the air cushion 10 to prevent and reduce bleeding of the air back into the air cushion 10.

The air chamber sensor 20 serves as a sensor control system that determines the immersion depth of an individual sitting on an air cushion. The sensor control system comprises two sensors. One sensor determines the lower level of immersion, e.g., the pressure strip sensors 33, while the second sensor, e.g., the magnetic reed switch 64, determines the upper level of immersion of the individual sitting on the air cushion.

The air chamber sensor 20 may be any shape that supports an air cushion. However, as shown in FIGS. 5-7, the air chamber sensor 20 is preferably a rectangular shape and is constructed using 4 layers of a material, such as flexible thin vinyl, coated polyurethane, coated nylon, rubber or other similar and flexible material. In other embodiments of the present invention, an air chamber sensor 20 is formed from two layers of material.

With continued reference to FIGS. 5-7, the first two layers of the air chamber sensor, bottom layer 76 and middle layer 74, form the core of the sensor system. These two layers may be sealed together with RF energy, adhesives, or other conventional sealing techniques. The first two layers contain channel walls 26 that run from one side of the air chamber sensor 20 to the other and form air channels 23. The distance between the channel walls 26 forms air channels 23. The distance between the channel walls 26 controls the maximum height the air chamber sensor 20 may be inflated. The end of the channel walls 27 cannot extend totally to the edge of the air cushion 29. A space must remain at the end of the air channels 23 to allow air to move freely from one air channel 23 to another. However, the distance from the edge of the air chamber sensor 20 to the end of the channel wall 27 should not exceed one half (½) of the distance between the channel walls 26. This provides for uniform support and expansion of the air sensor chamber 20. This uniform support and expansion is important to provide proper adjustment for the individual sitting on the air cushion. Without uniform support and expansion of the air sensor chamber 20, the proper lift necessary to achieve proper adjustment is not achieved.

With continued reference to FIGS. 5-7, a top layer 72 of material is sealed to the first two layers. Attached to top layer 72 is a pocket 24 that holds the sensor board. This sensor board 28 also holds and keeps in place a magnet that controls the actions of the magnetic reed switch that is located under the air chamber sensor.

The system of the present invention is a very dynamic responsive system. It has no "on" or "off" control, as the system is always in a "ready" position. The system only activates itself when needed as a response to either a high or low sitting situation. The pressure strip sensors 33, which direct bottoming-out, are always active and are not turned off. When an individual positions themselves on the system, it will automatically react. If the individual sits too low and bottoms out, the system will activate and adjust. If they are sitting too high, it will activate and adjust. If no action is taken, the individual can initiate adjustment by pushing the adjustment button 34. This will assure the lowest sitting position. The amount of pressure on the bottom-out sensor needed to activate the bottom-out sensor may be regulated by adjusting the width of the bottom-out strip sensors. Preferably, the pressure needed to activate the bottom-out sensor 33 is about six pounds.

The electronics that control the system operate as follows. To activate the system, the user either sits on the system or pushes an adjustment button 34. Upon successfully pushing the adjustment button 34, an audible alert will sound to provide feedback to the person that the adjustment procedure has been properly activated. This alert is always audible, even with an LED system in operation. At this point the electrically operated air valve 62 opens. This allows air in the air chamber sensor 20 to evacuate as well as air in the attached air cushion 10 to evacuate. As the air is removed, the sensor board 28 attached to the top of the air chamber sensor 20 immerses itself into the air chamber sensor 20. When the strips 22 attached to the sensor board 28 push themselves through to the pressure strip sensors 33, they close the circuit. This closes the air valve 62 and starts the operation of the air pump 60. At this time, three simultaneous timing sequences in the microprocessor 50 may begin. These timing sequences begin anytime the bottom-out sensors are contacted, whether the activation was begun by pushing the adjustment button 34 or not. In some embodiments, rechargeable dry lead/acid batteries may be used for powering the present invention.

The first timing sequence activates an alarm 52 that indicates that the system is in a bottomed-out situation. The volume of the alarm may be adjusted from a high setting to a low setting. The alarm may 52 have one or more time delayed settings, controlled by a series of dip-switches, and controlled by the microprocessor 50. Preferably, the alarm 52 has four time delayed settings. The first setting may be a "0" time delay and activates an alarm 52 immediately upon contacting the pressure strip sensors 33, i.e, bottoming-out. The "0" delay may be a testing position or a LED/read out setting. The other three time delay settings extend the time up to 30 seconds before the alarm activates after contacting the pressure strip sensors 33. This time setting, for example, may be changed by the programming of the microprocessor 50.

The bottom-out alarm is a continuous alarm that will not stop until the pressure strip sensors 33 are no longer being contacted. This is an important feature of the present invention as an individual who is bottomed-out may develop decubitus ulcers.

A second timing sequence extends the operation of the air pump 60 for a short duration of time after the pressure strip sensors 33 are no longer being contacted. This serves to lift the strips 22 located on the sensor board 28 slightly off the pressure strip sensors 33.

A third timing sequence is also initiated by pushing the adjustment button 34. This timing sequence times out the operation of the system from the time the adjustment button is pushed until the time the pressure sensor strips 33 are contacted. This is important since during transportation or storage of the system, the adjustment button 34 may be accidentally activated, i.e., by storing the system in a car trunk, etc. If the air valve 62 is opened accidentally, it will remain open until the pressure strip sensors 33 are contacted. If the system is being stored overnight, for example, and is not in use, the air valve 62 will remain open and drain the batteries 68 making the system inoperative. After the third timing sequence of approximately two minutes which can be changed by programming and the pressure strips sensors 33 are not activated, the microprocessor 50 will close the air valve and shut down the system until it is reactivated by pushing the adjustment button 34 or by applying pressure to the pressure strips sensors 33.

The present invention provides many advantages. If a person changes their sitting position by leaning to one side or another, moving forward on the air cushion, or even lifting and crossing a leg, a bottom-out or over-inflation situation may occur. If a bottom-out situation occurs, the air pump 60 may activate to add air to the system until the bottom-out condition has been corrected. If the individual then returns to a more upright position, then the system may have too much air and will be in an overinflation mode resulting in a release of air through the air valve 62.

Other advantages of the present invention include means to close the air valve 62 if it is unintentionally opened. If the air in the air chamber sensor should increase in pressure while sitting in storage, etc., the reed switch 64 will activate the opening of the air valve 62. The air valve 62 will only be closed after the air has evacuated sufficiently to allow contact with the pressure strip sensors 33. If no one is sitting on the unit, there will not be sufficient pressure exerted on the pressure strip sensors 33 to complete the circuit and close the air valve 62. The air valve 62 will remain open and drain the batteries 68 of their power. To save battery power, the air valve 62, if not closed in a preset time period of approximately 2 minutes, will be closed by the microprocessor 50. The system may be reactivated by pressing the adjustment button 34 or pressing the pressure strip sensors 33. After the air valve 62 is closed, the audible alarm will come on. The audible alarm is a pulsating alarm that indicates overinflation.

In some situations, the user of the system may not want an audible alarm to activate. In this case, the audible alarm can be turned off and replaced with a LED/visual read out light alarm. The LED light alarm may be incorporated into the present invention in several ways. The first version uses a lighted push-button 37 mounted on the front of the plastic housing. Pushing the button in will result in the LED located inside the push-button to flash the alarm. Pushing the button again will reactivate the audible alarm.

Figure 11:
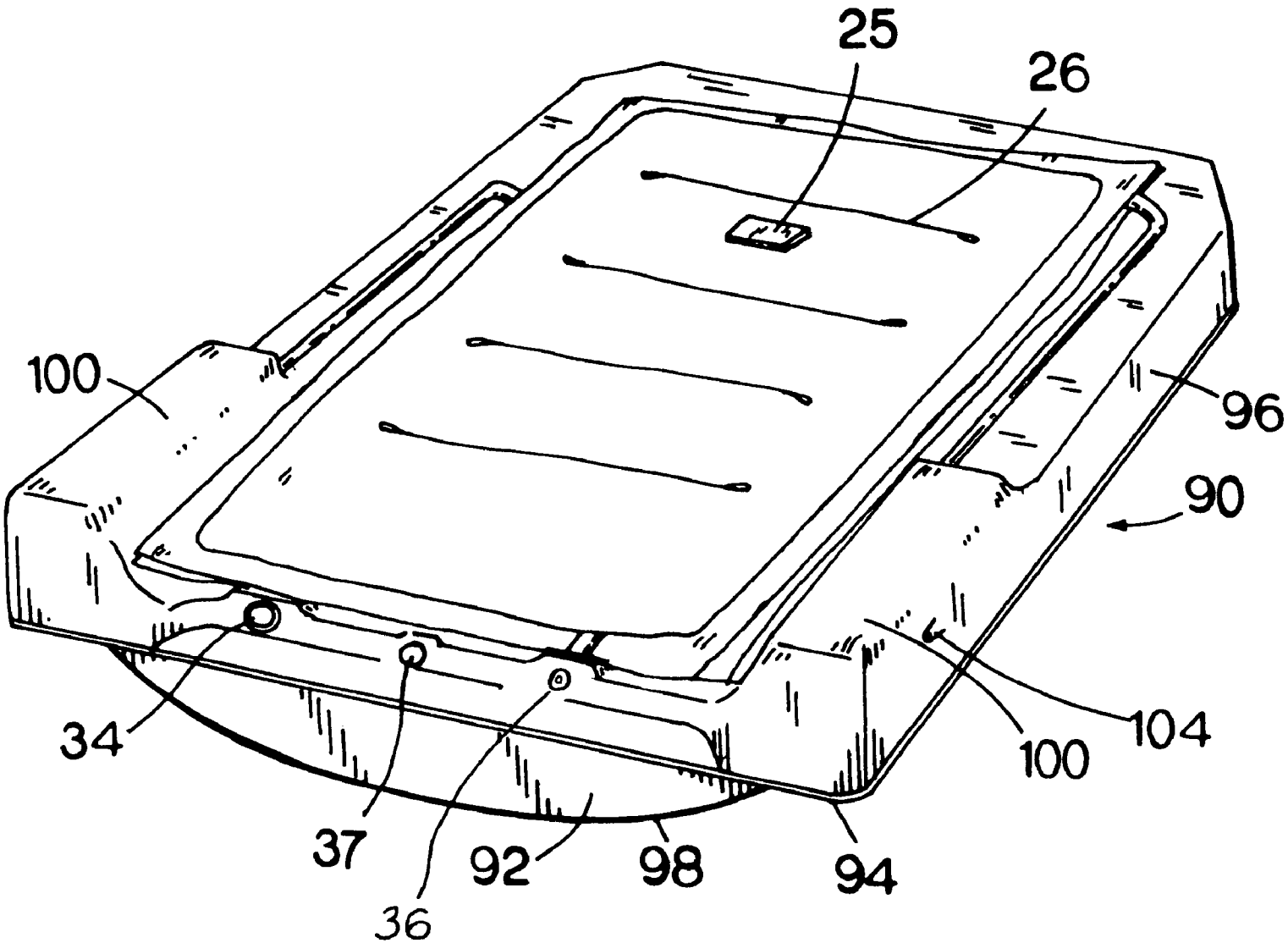
FIG. 11 is a perspective view of an embodiment of the present invention providing a low height housing with a curved bottom for sling chair.

In certain embodiments, as shown in FIG. 11, a socket 104 is mounted on the side of the housing 30. An LED/visual read out light assembly can be quickly mounted on the arm of the wheelchair and can be plugged into the socket. As soon as this unit is plugged into the socket, the audible alarm is automatically disconnected. If accidentally unplugged, the audible alarm system will be automatically reactivated.

Figure 12:
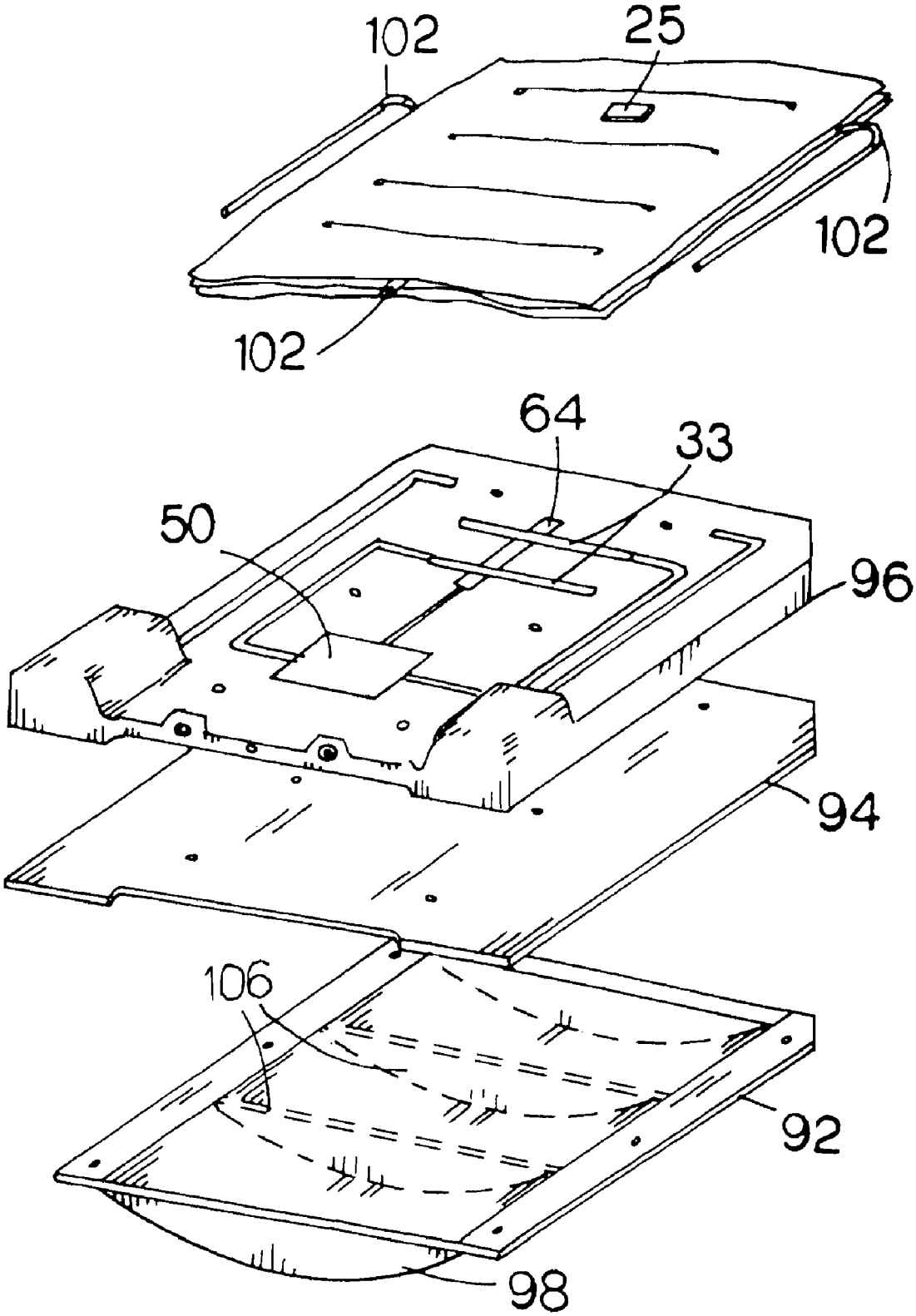
FIG. 12 is a exploded view of the low height housing embodiment.
Figure 13:
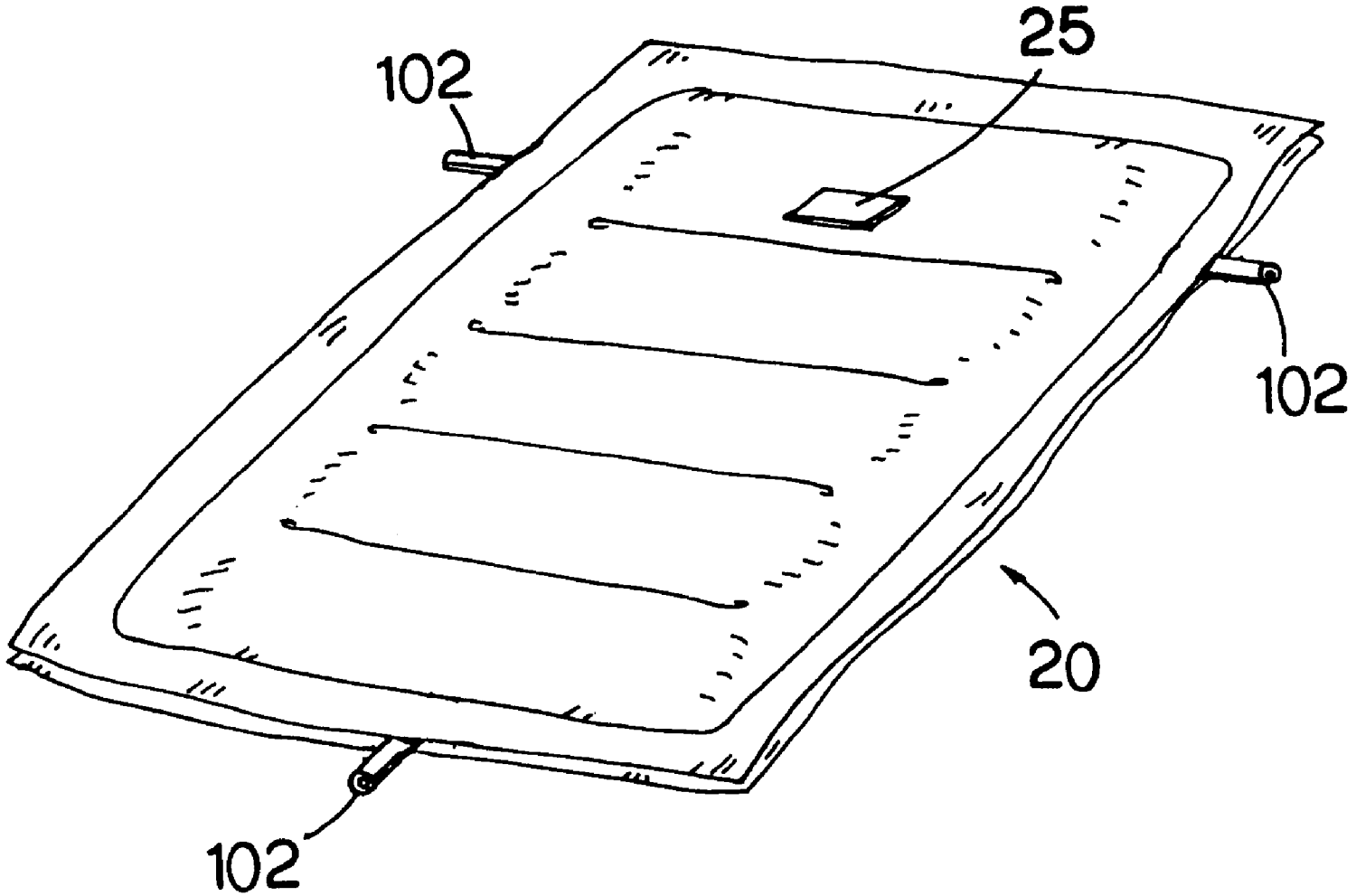
FIG. 13 is a view of an air chamber sensor having perimeter air connects.

In another embodiment of the present invention, as shown in FIGS. 11-13, a low height housing structure 90 is shown with an air chamber sensor 20, having perimeter air connects 102. This embodiment provides a thinner air cushion control system, which may be easier for an individual seated in a wheelchair to transfer from. In this embodiment, air connects are removed from the bottom surface of the air chamber sensor 20 thus reducing the height of the air cushion control system. The reduced height of the housing is also important for the wheelchair user to get their legs under a standard table. In this embodiment, compartments 100 provide space for the batteries, air pump, air valve and other structures. The low height housing structure 90 may be smaller than about ½ of an inch in height. In some embodiments, the low height housing structure 90 may be about ¼ of an inch in height under the buttocks area.

The low height housing structure 90 is comprised of a bottom housing layer 92, a middle housing layer 94, and a top housing layer 96. The bottom housing layer 92 is provided with a curved bottom 98 for conforming to a sling-type wheelchair seat commonly used. The bottom housing layer 92 is easily removable as it is attached to middle housing layer 94 by screws or other means. The bottom housing layer 92 may have ribs 106 for support. The ribs 106 and bottom housing layer 92 may be vacuum formed.

In practice, the bottom housing layer 92 may be removed if it is desired to use the present invention with a wheelchair or other chair having a flat surface. The present invention may be provided to the consumer with a range of bottom housing layers 92 to accommodate different wheelchairs and accommodate different sling-type wheelchairs. Sling-type wheelchairs may vary in sag from about ½ inch to about 2 inches.

Top housing layer 96 may be provided with chases or voids molded into the material of the top housing layer 94 to provide for the wiring and air tubing. By using chases or voids, a reduction in the height of the housing 30 is achieved. The top housing layer 96 may be molded to form the chases, voids, and compartments 100.

The middle housing layer 94 may be of a thin (approximately ⅛ of an inch) lightweight material such as aluminum or plastic with a honeycomb interior. Plastic or Kraft paper may also be used in forming the middle housing layer 94.

In the embodiment shown in FIGS. 11-13, the air cushion 20 comprises two layers of material. The two layers are welded together with perimeter air connects 102 protruding from a seam formed by the welding of the two layers. This provides air chamber sensor 20 that does not have air connects below, thusly all air connects may be in one plane. The magnet 25 may be attached or integral to the upper layer of the air chamber sensor 20. Of course, the perimeter air connects 102 may be used with any air chamber sensor 20 of the present invention.

Figure 14:
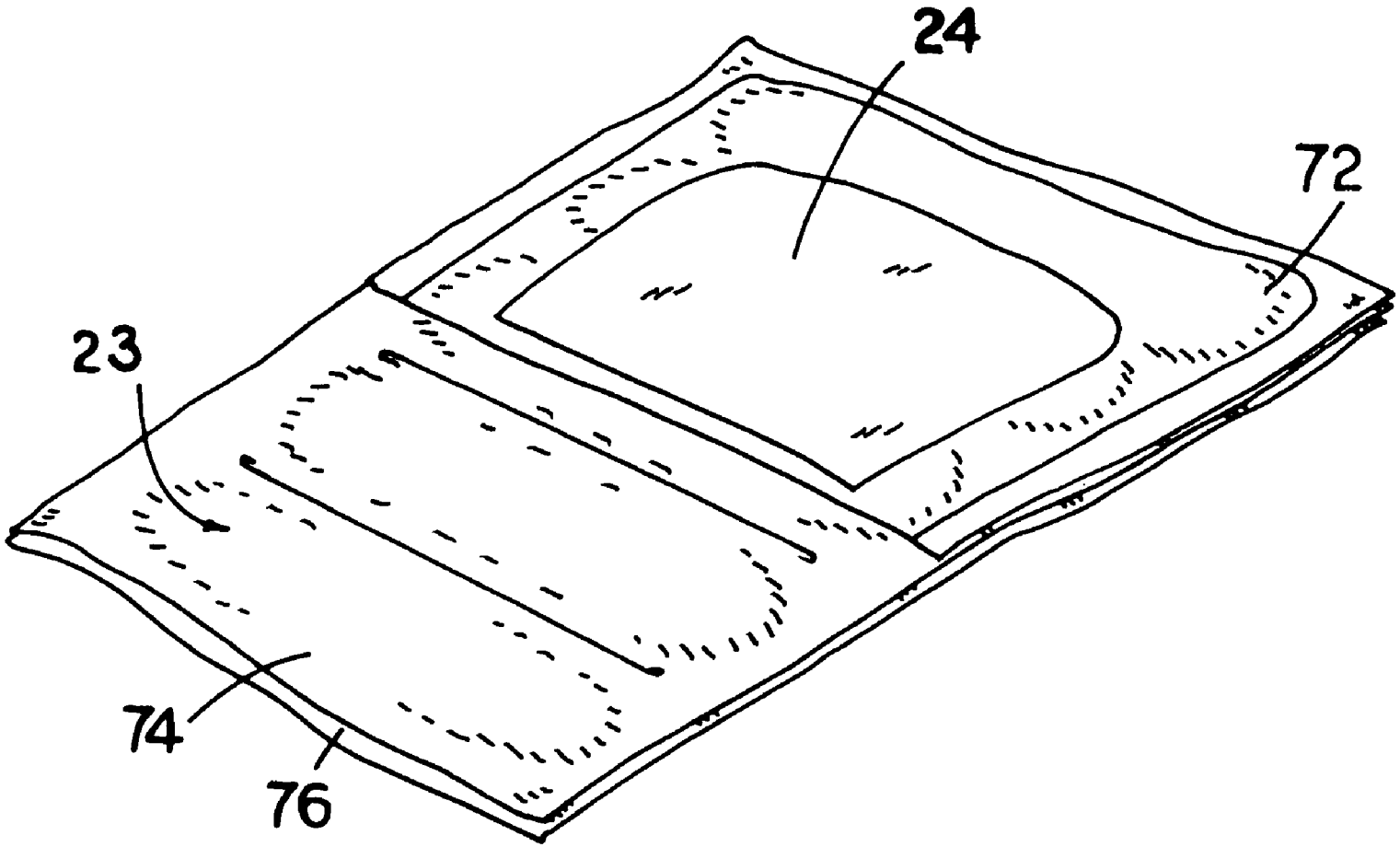
FIG. 14 is a view of an embodiment with a reduced top cover.

In another embodiment as shown in FIG. 14, the top layer 72 may be reduced to only cover a portion of the middle layer 74. The reduced top layer 72 may provide greater flexibility for the air chamber sensor 20 to inflate.

In another embodiment of the present invention, the housing and the air chamber sensor may be enclosed by a cover. The cover may be made of a washable material and may be closed with a zipper, Velcro, or other closing means. The cover may have a non-skid material attached or integral with the bottom of the cover to maintain stability of the system on the wheelchair or other seating surface. The cover may have holes therein for the adjustment button, air connects, and other features.

What is claimed is:

1. An air cushion immersion control system comprising:

an air chamber sensor including an air chamber, a bottom out sensor and an overinflation sensor;

an air pump to inflate the air chamber sensor, an air valve to release air from the air chamber sensor;

means to connect the air chamber sensor of the air cushion control system to an air cushion; and a microprocessor monitoring the bottom out sensor and the over inflation sensor, the microprocessor controlling the air pump and the air valve to adjust a depth of immersion of an individual into the air cushion by the inflation and the release of the air from the air chamber sensor and the air cushion.

2. The air cushion immersion control system according to claim 1, wherein a housing contains the air pump, the air valve, the microprocessor, the bottom out sensor, the over inflation sensor, the air chamber sensor, and batteries.

3. The air cushion immersion control system according to claim 2, wherein the air chamber sensor connects to the housing by air tubes or air connects.

4. The air cushion immersion control system according to claim 2, wherein the housing is comprised of a lower housing and an upper housing, wherein the lower housing is removably connected such that the lower housing may be interchanged with a second lower housing of a different size or a different design.

5. The air cushion immersion control system according to claim 2, wherein the microprocessor manages a low voltage monitoring system for batteries that power the air cushion immersion control system, wherein the low voltage monitoring system will activate an alarm when a low voltage is detected and will confirm the correct installation of the batteries with a short audible alarm.

6. The air cushion immersion control system according to claim 2 further comprising a silent LED light system or a visual read out display.

7. The air cushion immersion control system according to claim 6, wherein the silent LED light system or the visual read out display signals a bottom-out condition, an overinflation, or that an adjustment process is occurring.

8. The air cushion immersion control system according to claim 6, wherein the microprocessor reinstates an audible alarm if the silent LED light system or the visual read out display is disconnected.

9. The air cushion immersion control system according to claim 6, wherein the LED light system or the visual read out display is plugged into the microprocessor.

10. The air cushion immersion control system according to claim 6, wherein an adjustment button on the housing contains an LED light and actuating the adjustment button first turns on the LED light and again actuating the adjustment button activates an audible alarm system.

11. The air cushion immersion control system according to claim 2, wherein the housing comprises: a bottom housing layer, a middle housing layer, and a top housing layer; and wherein the top housing layer is molded and comprises chases or voids for directing wiring and tubing and further comprises compartments to house the batteries, the air pump, and the air valve.

12. The air cushion immersion control system according to claim 11, wherein the middle housing layer is comprised of a thin material.

13. The air cushion immersion control system according to claim 1, wherein the microprocessor performs a timing sequence that measures a duration that the air cushion is in a bottom-out condition without an audible or a visible alarm being activated.

14. The air cushion immersion control system according to claim 13, wherein the microprocessor activates an alarm, if the bottom-out condition persists beyond a programmed time period.

15. The air cushion immersion control system according to claim 1, wherein the microprocessor manages a battery saver system that closes the air valve and deactivates the air cushion immersion control system if an adjustment button is activated without an occupant on a seat cushion connected to the air cushion immersion control system.

16. The air cushion immersion control system according to claim 1, wherein the microprocessor controls the air pump to continue to operate for a designated period of time after the bottom-out sensors are no longer activated.

17. The air cushion immersion control system according to claim 1, further comprising an adjustment button that when activated signals the microprocessor to open the air valve to release air from the air chamber sensor and the air cushion until a bottom-out condition is determined by contacting the bottom-out sensor which activates the microprocessor to close the air valve and activate the air pump.

18. The air cushion immersion control system according to claim 1, further comprising an adjustment button that when activated signals the microprocessor to:

confirm with an audible sound that the adjustment button has been activated;

perform a timing sequence that measures a duration that an air cushion is in a bottom-out condition without an audible or a visible alarm being activated;

manage a battery saver system that closes the air valve and deactivates the air cushion control system if the adjustment button is activated without an occupant on a seat cushion connected to the air cushion immersion control system; or control the air pump to continue to operate for a short period of time after the bottom-out sensors are no longer tripped.

19. The air cushion immersion control system according to claim 1, further comprising bottom-out sensors that when activated signal the microprocessor to:

perform a timing sequence that measures a duration that an air cushion is in a bottom-out condition without an audible or a visible alarm being activated;

manage a battery saver system that closes the air valve and deactivates the air cushion immersion control system if the adjustment button is activated without an occupant on a seat cushion connected to the air cushion control system; or control the air pump to continue to operate for a short period of time after the bottom-out sensors are no longer tripped.

20. The air cushion immersion control system according to claim 1, wherein the microprocessor closes the air valve of the air cushion immersion control system after a programmed time delay if an adjustment process is activated without an occupant on a seat cushion connected to the air cushion immersion control system.

21. The air cushion immersion control system according to claim 1, wherein the microprocessor closes the air valve of the air cushion control system after a programmed time delay if an adjustment process is activated by an increase in internal pressure in the air chamber sensor due to increased temperature, pressure, or altitude and the bottom out sensors have not been contacted.

22. The air cushion immersion control system according to claim 1, wherein the air cushion control system will automatically recognize an occupant by an air pressure activated switch and activates an adjustment procedure.

23. The air cushion immersion control system according to claim 1, wherein the air cushion immersion control system will automatically recognize an occupant by an externally mounted strip sensor or a mechanical switch and activates an adjustment procedure.

24. The air cushion immersion control system according to claim 1, wherein the microprocessor performs a timing sequence that measures a duration that the air cushion is in an over inflation condition without an audible or a visible alarm being activated.

25. The air cushion immersion control system according to claim 24, wherein the microprocessor activates an alarm, if the over inflation condition persists beyond a programmed time period.

26. The air cushion immersion control system according to claim 1, further comprising bottom-out sensors that when activated signal the microprocessor to:

perform a timing sequence that measures a duration that an air cushion is in an over inflated condition without an audible alarm or visible alarm being activated;

manage a battery saver system that closes the air valve and deactivates the air cushion immersion control system if the adjustment button is activated without an occupant on an air cushion connected to the air cushion control system; or control the air pump to continue to operate for a short period of time after the bottom-out sensors are no longer tripped.

27. An air cushion immersion control system comprising:

an air chamber sensor, including an air chamber, a bottom-out sensor, and an overinflation sensor, an air pump to inflate the air chamber sensor and air cushion, and an air valve to release air from the air chamber sensor and cushion; and, means to connect the air chamber sensor of the air cushion immersion control system to an air cushion;

the air chamber sensor formed by sealing together two layers of a material, channel walls in the air chamber sensor separating the air chamber sensor into multiple interior air channels, the air channels extending throughout the length and width of the air chamber sensor; the distance from an edge of the air chamber sensor to an end of the channel wall does not exceed one half of the distance between the channel walls; and wherein the spacing of channel walls controls inflation height and air distribution within the air chamber sensor and the air cushion; and wherein the overinflation sensor comprises a magnet and a reed switch.

28. The air cushion immersion control system according to claim 27, wherein the ends of the channel walls do not extend totally to the edge of the air chamber sensor.

29. The air cushion immersion control system according to claim 27, wherein a third layer of material is sealed to the first two layers of the air chamber sensor, the third layer containing a vent hole;

wherein a fourth pocket layer is attached to the third layer and is capable of holding a sensor board, the sensor board holding a magnet, and sensor strips; and wherein the pocket layer aligns the magnet and sensor board with the bottom-out sensors and the reed switch.

30. The air cushion immersion control system according to claim 27, wherein the air chamber sensor assembly has air connects on its sides or bottom.

31. An air cushion immersion control system comprising:

an air chamber sensor, a bottom out sensor and an overinflation sensor;

an air pump to inflate the air chamber sensor and cushion, an air valve to release air from the air chamber sensor and cushion;

means to connect the air chamber sensor of the air cushion control system to an air cushion;

the air chamber sensor with multiple interior air channels, the air channels containing support strips;

wherein the support strips reduce the bleeding of air from the air chamber sensor back into the air cushion when the air cushion is unoccupied.

32. The air cushion immersion control system according to claim 31, wherein the support strips are a foam material, a plastic material, a combination thereof or any other hard material.

33. The air cushion immersion control system according to claim 31, wherein the air chamber sensor includes the air chamber formed by sealing together two layers of material with multiple air channels that contain the support strips wherein the support strips are capable of activating the bottom-out sensor; and a magnet can be contained within the support strip.

34. The air cushion immersion control system according to claim 31, wherein the air chamber sensor comprises the air chamber formed by sealing together two layers of material with multiple air channels that contain the support strips, wherein the support strips are capable of activating the bottom-out sensor; and a pocket on top of the third layer containing a sensor board, magnet and activation control strips.

* * * * *